US010092085B2

(12) United States Patent
Willison et al.

(10) Patent No.: US 10,092,085 B2
(45) Date of Patent: Oct. 9, 2018

(54) FLORAL ATTACHMENT ASSEMBLY

(71) Applicant: Irene's Floral Pin LLC, Forest Grove, OR (US)

(72) Inventors: Irene M. Willison, Forest Grove, OR (US); Richard E. Gomes, Hillsboro, OR (US); Merri Ott-Gomes, Hillsboro, OR (US)

(73) Assignee: Irene's Floral Pin LLC, Forest Grove, OR (US)

( * ) Notice: Subject to any disclaimer, the term of this patent is extended or adjusted under 35 U.S.C. 154(b) by 1 day.

(21) Appl. No.: 15/680,473

(22) Filed: Aug. 18, 2017

(65) Prior Publication Data

US 2018/0049541 A1 Feb. 22, 2018

Related U.S. Application Data

(60) Provisional application No. 62/377,124, filed on Aug. 19, 2016.

(51) Int. Cl.
*A45F 5/08* (2006.01)

(52) U.S. Cl.
CPC ..... *A45F 5/08* (2013.01)

(58) Field of Classification Search
CPC ..... A45F 5/08
See application file for complete search history.

(56) References Cited

U.S. PATENT DOCUMENTS 1,647,197 A * 11/1927 Salmon ..... A45F 5/08 24/6
2,613,412 A * 10/1952 Robinson ..... A44B 9/00 24/357
3,088,295 A * 5/1963 Haines ..... A44B 1/04 24/108
3,360,835 A * 1/1968 Foertmeyer ..... A44B 1/34 24/114.4
3,735,447 A 5/1973 Abraham
3,982,303 A 9/1976 Shulkin
4,229,877 A * 10/1980 Fagan ..... A44B 9/16 24/6
5,123,188 A 6/1992 Loda
D334,905 S * 4/1993 Ritz ..... 24/6

(Continued)

OTHER PUBLICATIONS

The U.S. Receiving Office, International Search Report for PCT/US2017/047513 dated Oct. 25, 2017, 2 pages.

(Continued)

*Primary Examiner* — Robert Sandy
*Assistant Examiner* — David M Upchurch
(74) *Attorney, Agent, or Firm* — Kolisch Hartwell, P.C.

(57) ABSTRACT

A floral attachment assembly for attaching a floral arrangement to a garment is disclosed. The floral attachment assembly may include a base and a pin assembly with a body, a first plurality of pins, and a second plurality of pins. The first plurality of pins may be configured to engage the floral arrangement. The first plurality of pins may extend in a direction generally opposite the second plurality of pins. The base may be configured to removably mate with the second plurality of pins. The second plurality of pins may be configured to pierce the garment and secure the pin assembly to the garment when mated with the base.

14 Claims, 5 Drawing Sheets

(56) References Cited

U.S. PATENT DOCUMENTS

| | | | | |
|---|---|---|---|---|
| 5,836,017 | A * | 11/1998 | Hironaga | A45F 5/08 2/69 |
| 6,279,202 | B1 * | 8/2001 | Wojdylak | A44B 9/16 24/12 |
| 6,389,649 | B1 | 5/2002 | Metzler | |
| 6,715,184 | B1 | 4/2004 | Droschak | |
| 7,950,111 | B2 | 5/2011 | Katnik | |
| 2010/0287766 | A1 * | 11/2010 | Peterson | A45F 5/08 29/798 |
| 2012/0023708 | A1 * | 2/2012 | Crilly | A45F 5/08 24/5 |

OTHER PUBLICATIONS

The U.S. Receiving Office, Written Opinion for PCT/US2017/047513 dated Oct. 25, 2017, 9 pages.

* cited by examiner

FLORAL ATTACHMENT ASSEMBLY

CROSS-REFERENCE TO RELATED APPLICATION

This application claims priority to U.S. Provisional Patent Application Ser. No. 62/377,124, filed Aug. 19, 2016, which is hereby incorporated by reference in its entirety.

FIELD

This disclosure generally relates to a floral attachment assembly. More specifically, it relates to systems and methods for attaching and securing a floral arrangement to a garment.

BACKGROUND

Floral arrangements, such as boutonnieres and corsages, are commonly used to adorn or personalize a person's clothing for special occasions, such as weddings, dances, graduations, parties, and the like. Traditionally, floral arrangements are attached to garments using one or more standard straight pins that are threaded and/or pierced through the garment and floral arrangement. However, attaching a floral arrangement using standard straight pins can be cumbersome and difficult.

For example, a person attaching the floral arrangement may have difficulty piercing the floral arrangement with the pin due to the thickness of the flower stems and/or the wires used to create the floral arrangement. Additionally, attaching the floral arrangement with a straight pin commonly results in the wearer and/or the person attaching the floral arrangement being pricked by the exposed pin tip, thereby causing pain and/or injury. Moreover, floral arrangements attached with a straight pin tend to shift from its original location or fall off, especially while dancing. This shifting or sagging of the floral arrangement can damage or deform a person's clothing or garments, and frequent re-attachment may be necessary. Additionally, frequent reattachment and/or manipulation of the floral arrangement may damage and/or affect the appearance of the flowers of the floral arrangement. Furthermore, a second person or non-wearer of the floral arrangement is commonly needed to assist in the attachment of a floral arrangement to a garment when the garment is being worn.

SUMMARY

The present disclosure provides systems and methods relating to a floral attachment assembly for attaching a floral arrangement to a garment. A garment may include clothing, clothing accessories, fabrics, among others. In some embodiments, a floral attachment assembly may include a pin assembly configured to fasten a floral arrangement to a garment when mated with a base. The pin assembly may include a body portion configured to support a floral arrangement, a first plurality of pins protruding from the body in a first direction, and a second plurality of pins protruding from the body in a second direction generally opposite the first direction. The first plurality of pins may be configured to secure the floral arrangement to the body portion. The second plurality of pins may be configured to pierce the garment and secure the pin assembly to the garment when mated with the base. The base may be configured to receive and removably attach to the second plurality of pins.

In some embodiments, a floral attachment assembly may include a body with a first side and an opposing second side, a first elongate protrusion extending out from the first side, a second elongate protrusion extending out from the second side, and a base configured to receive the second elongate protrusion. The first elongate protrusion may be configured to engage a floral arrangement, and the second elongate protrusion may be configured to secure the body to a garment when received by the base. In some embodiments, the first elongate protrusion may be a first end of a double-ended pin and the second elongate protrusion may be a second end of the double-ended pin. The double-ended pin may extend through the body.

Some embodiments provide a method of attaching a floral arrangement to a garment, which may include securing a floral arrangement to a pin assembly, disposing a base portion on a first face of a garment, disposing the pin assembly on a second face of the garment, and piercing a pin of the pin assembly through the garment into the base. The method may additionally include embedding a second pin of the pin assembly in the floral arrangement.

Features, functions, and advantages may be achieved independently in various embodiments of the present disclosure, or may be combined in yet other embodiments, further details of which can be seen with reference to the following description and drawings.

DESCRIPTION

Overview

Various embodiments of floral attachment assemblies, and of systems and methods for attaching and securing a floral arrangement to a garment using a floral attachment assembly, are described below and illustrated in the associated drawings. Unless otherwise specified, the floral attachment assembly and/or its various components may, but are not required to, contain at least one of the structures, components, functionality, and/or variations described, illustrated, and/or incorporated herein. Furthermore, the structures, components, functionalities, and/or variations described, illustrated, and/or incorporated herein in connection with the present teachings may, but are not required to, be included in other similar embodiments. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Examples, Components, and Alternatives

The following examples describe selected aspects of exemplary embodiments as well as related systems and/or methods. These examples are intended for illustration and should not be interpreted as limiting the entire scope of the present disclosure. Each section may include one or more distinct inventions, and/or contextual or related information, function, and/or structure.

Example 1

Figure 1:
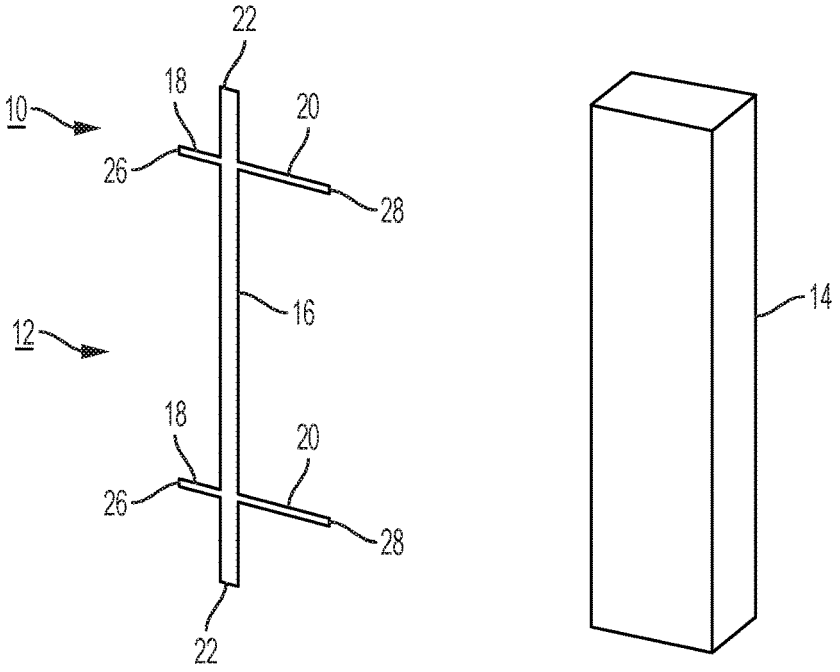
FIG. 1 is an isometric view of an example of a floral attachment assembly in accordance with the present disclosure.

FIG. 1 shows an example of a floral attachment assembly, generally indicated at 10. In this embodiment, floral attachment assembly 10 includes a pin assembly 12 and a base 14. In other examples, floral attachment assembly 10 may include more or less components. For example, floral attachment assembly 10 may include a pin assembly, a base, and a floral arrangement.

It is noted that floral attachment assembly 10 is configured to support and secure a generally linear shaped floral arrangement (not shown), but a floral attachment assembly may have any dimensions and shaping suitable for supporting and/or securing various shapes and sizes of floral arrangements, such as triangular, curved, circular, among others. It is also noted that although FIG. 1 shows floral attachment assembly 10 including one pin assembly and one base, the floral attachment assembly may have any suitable number of pin assemblies and/or bases. It should also be noted that although FIG. 1 shows pins and/or a pin assembly, floral attachment assembly 10 may include any suitable structure to facilitate attaching and/or securing a floral arrangement to a garment. For example, the floral attachment assembly may include one or more fasteners, including pins, prongs, adhesives, snaps, closures, among others. Floral attachment assembly 10 may be made of one or more suitable materials, such as metals, polymers, rubbers, latexes, textiles, and/or other materials.

Pin assembly 12 may include a first set of pins 18 and a second set of pins 20 disposed proximate distal ends 22 of a body 16 of the pin assembly. Although FIG. 1 shows two (2) pins in first set of pins 18 and two (2) pins in second set of pins 20, pin assembly 12 may have any suitable number and/or sets of pins. It is also noted that the first set of pins and the second set of pins are disposed proximate distal ends 22 of the body and extend generally perpendicular relative to the body, but one or more pins of the first set of pins and/or one or more pins of the second set of pins may be disposed and/or attached in any suitable position and/or orientation on the body. Pin assembly 12 may be made of one or more suitable materials, such as metals, polymers, among others. Pin assembly 12 may be one or more suitable colors, such as green, brown, black, and/or white.

Body 16 of pin assembly 12 may be any suitable shape(s) and/or dimension(s) to support and/or facilitate attachment of a floral arrangement to a garment. For example, body 16 may be sized to support various sizes and/or types of floral arrangements (e.g. corsages, boutonnieres, etc.). In some examples, body 16 may be sized and/or shaped to allow a user to wrap fabric and/or adhesives (e.g. floral tape) around the body and/or other components of the pin assembly and/or floral attachment assembly. Additionally, or alternatively, body 16 may be configured to adjust and/or adapt to one or more sizes and/or types of floral arrangements. For example, body 16 may include one or more structures to facilitate adjustment to various sizes and/or types of floral arrangements, such as springs or elastic bands. Body 16 may be one or more suitable colors, such as green, brown, black, and/or white.

In this embodiment, first set of pins 18 are positioned approximately 180 degrees relative to second set of pins 20. In some examples, the first set of pins may be positioned less than 180 degrees relative to the second set of pins. In other examples, one or more pins of the first set of pins may have different orientations and/or positions relative to one or more pins of the second set of pins. First set of pins 18 and second set of pins 20 may have any suitable size(s) and/or shape(s). For example, first set of pins 18 may be shorter in length relative to second set of pins 20. In other examples, the first set of pins may be the same or longer in length relative to the second set of pins. In some examples, the first set of pins may have a larger or smaller diameter relative to the second set of pins.

One or more pins of the first set of pins and/or one or more pins of the second set of pins may be configured to pierce through fabrics, clothing, vegetation, adhesive tapes and/or other materials. For example, distal ends 26 of the first set of pins and/or distal ends 28 of the second set of pins may be tapered and/or sharpened to facilitate piercing through fabrics, clothing, vegetation, adhesive tapes and/or other materials. In some examples, distal ends 26 may be dull and/or rounded. This may help avoid piercing and/or damaging the flowers of a floral arrangement. Additionally, or alternatively, distal ends 28 may be dull and/or rounded. In some embodiments, one or more pins of the first set of pins and/or one or more pins of the second set of pins may be curved and/or include one or more structures to facilitate attachment to a floral arrangement and/or the base. In some embodiments, one or more pins of the first set of pins and/or one or more pins of the second set of pins may be configured to provide minimal damage and/or smaller holes in a garment and/or to a floral arrangement.

First set of pins 18 may be configured to attach and/or anchor a floral arrangement (e.g. corsage or boutonniere). For example, the first set of pins may be configured to facilitate anchoring and/or alignment of a floral arrangement. In some examples, first set of pins 18 may be configured to be embedded and/or contained within a floral arrangement. In some examples, first set of pins 18 may be configured to pierce one or more stems of a floral arrangement and/or fabrics or adhesives (e.g. floral tape).

Second set of pins 20 may be configured to engage and/or connect to a garment and/or base 14. For example, the second set of pins may be configured to pierce a garment and/or attach to a base. In some examples, the second set of pins may be configured to pierce a garment and/or partially pierce a base. In other examples, the second set of pins may be configured to pierce a garment and/or snap into a portion of a base.

Base 14 is configured to receive and/or secure pin assembly 12 to a selected position on a garment. For example, base 14 may be configured to receive and/or releasably attach to the pin assembly and/or one or more pins of the second set of pins. Base 14 may be made of one or more suitable materials, such as latexes, polymers, and/or rubbers. For example, base 14 may be made of a lightweight foam. Base 14 may be any suitable shape(s) and/or size(s) to facilitate positioning, securing, and/or anchoring of a floral arrangement to a garment. In some examples, the base may be sized to help distribute and/or spread the weight of a floral arrangement across a portion of a garment. Base 14 may include any suitable structure configured to facilitate attachment and/or securing the pin assembly. For example, base may include snaps, buttons, or other fasteners. Base 14 may be one or more suitable colors, such as black, green, taupe, and/or white.

Figure 2:
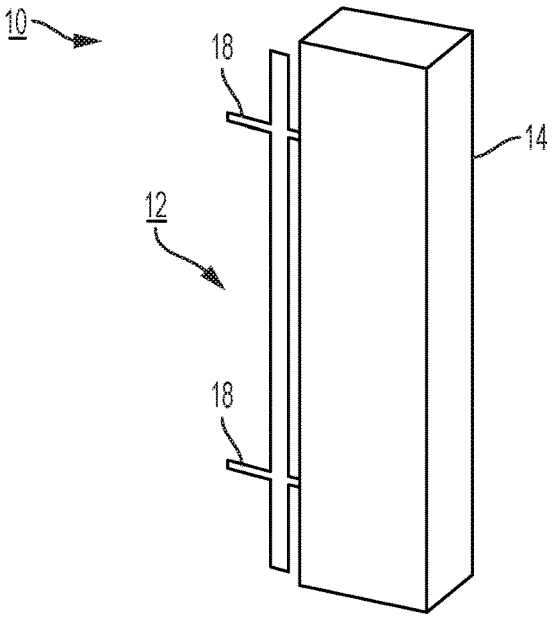
FIG. 2 is an isometric view of the floral attachment assembly of FIG. 1, showing the pin assembly in an engaged position with the base.

FIG. 2 shows pin assembly 12 in an engaged position with base 14. It should be noted that although it is not shown in FIGS. 1-2, at least a portion of a garment may be disposed between the body of the pin assembly and/or the pin assembly and the base. It should also be noted that although it is not shown in FIGS. 1-2 and/or FIG. 3, a floral arrangement may be secured and/or attached to the first set of pins and/or the pin assembly.

Figure 3:
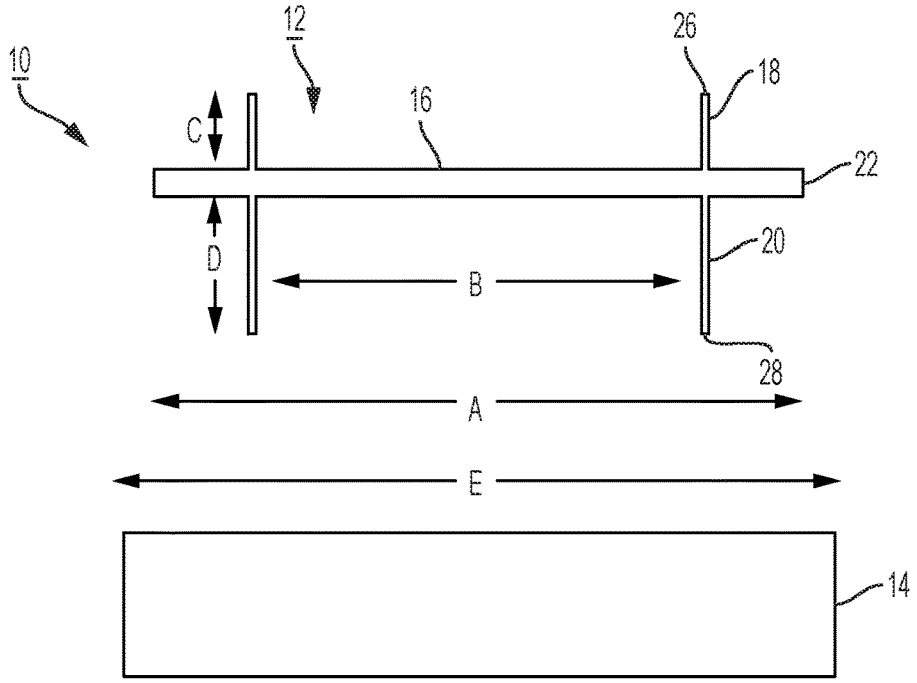
FIG. 3 is a schematic view of the floral attachment assembly of FIG. 1.

FIG. 3 is a schematic view of floral attachment assembly 10, showing relative dimensions of pin assembly 12 and base 14. Floral attachment assembly 10 may be any suitable shape(s) and/or dimension(s) to facilitate attachment and/or anchoring of a floral arrangement to a garment and/or base. For example, length A of the body may extend approximately 6.7 centimeters (cm), length C of the first set of pins may extend approximately 0.6 cm, length D of the second set of pins may extend approximately 1.3 cm, and/or length E of the base may extend approximately 8 cm. Each pin of the first set of pins and/or each pin of the second set of pins may be positioned on the body approximately 5.4 cm relative to each other. For example, length B of the body may extend approximately 5.4 cm. Additionally, or alternatively, base 14 may be approximately 1.2 cm thick. This configuration may help facilitate attachment and/or securing a corsage type of floral arrangement or similar.

In some examples, length A of the body may extend approximately 6 cm in length, length C of the first set of pins may extend approximately 0.6 cm, length D of the second set of pins may extend approximately 1.1 cm, and/or length E of the base may extend 7 cm. Each pin of the first set of pins and/or each pin of the second set of pins may be positioned on the body approximately 3.5 cm relative to each other. For example, length B of the body may extend approximately 3.5 cm. Additionally, or alternatively, base 14 may be approximately 1.2 cm thick. This configuration may help facilitate attachment and/or securing a boutonniere type of floral arrangement or similar. In other examples, the floral attachment assembly may have any suitable size(s) and/or shape(s). For example, length C may extend approximately 0.5 cm for one pin of first set of pins and length C may extend approximately 0.25 cm for the other pin of the first set of pins.

Example 2

Figure 4:
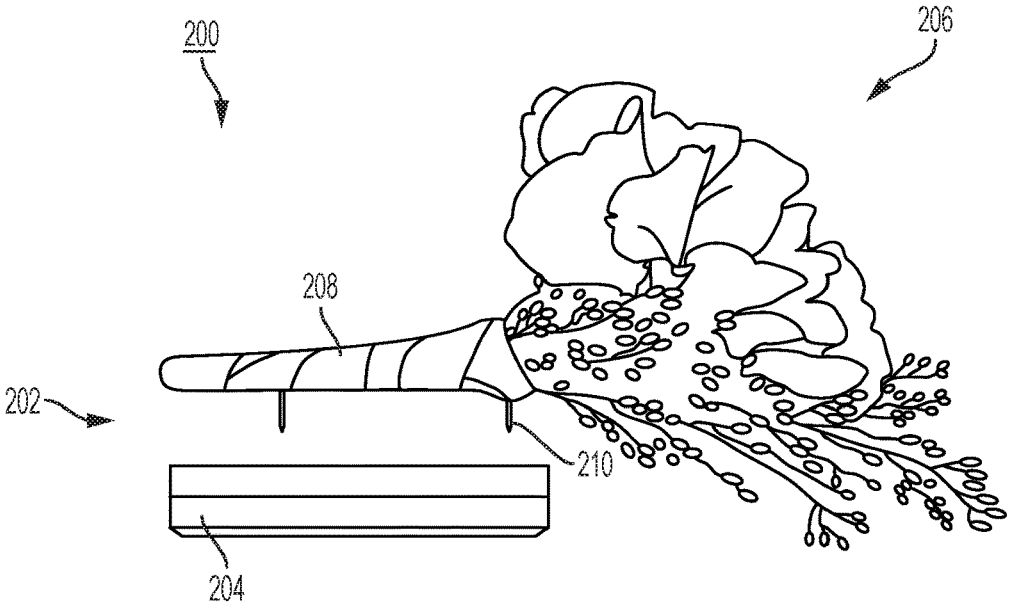
FIG. 4 is a side view of another example of a floral attachment assembly, with a floral arrangement being positioned and secured to a pin assembly.

Another example of a floral attachment assembly is shown in FIG. 4, and generally designated at 200. Unless explicitly excluded, floral attachment assembly 200 may include one or more components and/or one or more functions of other floral attachment assemblies described in the present disclosure. Floral attachment assembly may include a pin assembly 202 and a base 204. Pin assembly may include a first set of pins (not shown) and a second set of pins 210. As shown in FIG. 4, pin assembly 202 is attached to a floral arrangement 206. It should be noted that the pin assembly is at least partially embedded and/or secured to the floral arrangement with a floral tape 208, thus facilitating the securing and/or anchoring of the floral arrangement to a garment. The first set of pins may be configured to facilitate positioning and/or alignment of the pin assembly relative to the floral arrangement. In some examples, the first set of pins may be configured to pierce the floral arrangement and/or one or more stems of a floral arrangement. It should also be noted that the floral tape is wrapped around the pin assembly and/or a body (not shown) of pin assembly such that second set of pins 210 remain exposed, thus facilitating piercing and/or engaging with a garment and/or base 204.

Example 3

Figure 5:
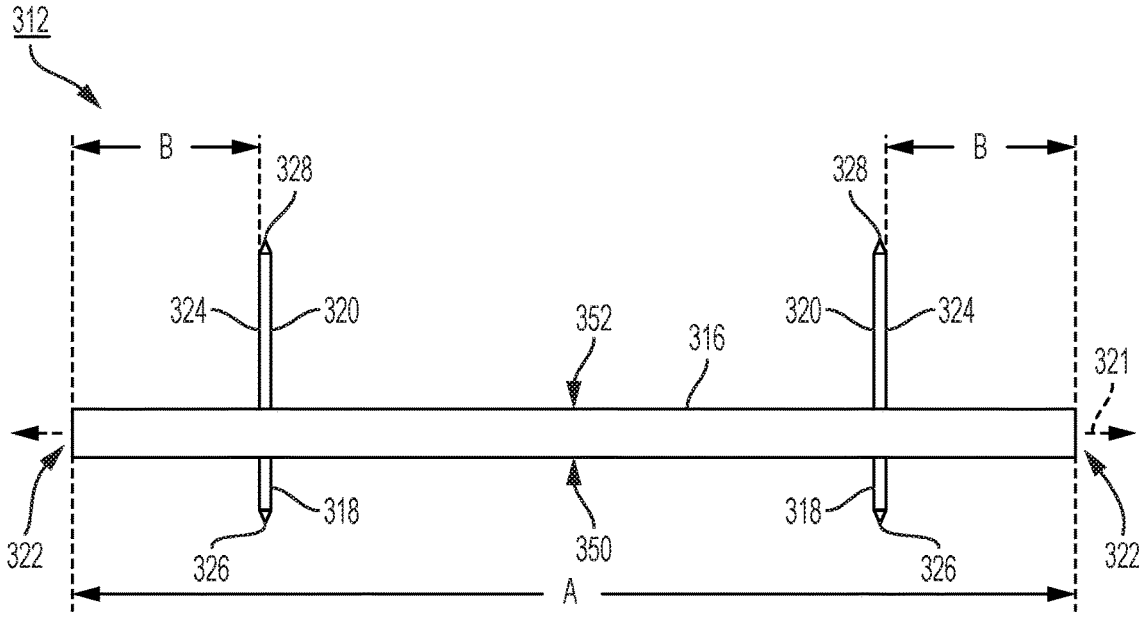
FIG. 5 is a side view of another example of a pin assembly.
Figure 6:
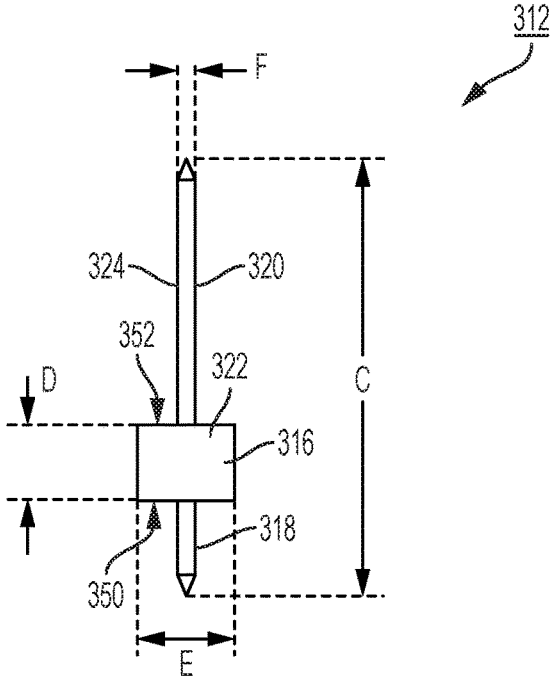
FIG. 6 is an end view of the pin assembly of FIG. 5.

FIGS. 5-6 show another example of a pin assembly generally designated at 312. The pin assembly includes a generally rectangular body 316 having a first side 350 and a second opposing side 352, a first set of elongate protrusions 318 extending from the first side of the body, and a second set of elongate protrusions 320 extending from the second side of the body. Although the first set of elongate protrusions and the second set of elongate protrusions of pin assembly 312 are each shown to include two elongate protrusions, the first set of elongate protrusions and/or the second set of elongate protrusions may include any suitable number of elongate protrusions. First set of elongate protrusions 318 extend from the first side of the body in a first direction, and second set of elongate protrusions 320 extend in a second direction generally opposite the first direction. Body 316 defines a longitudinal axis 321, with the first and second directions being perpendicular to the longitudinal axis.

In this embodiment, each elongate protrusion of the first and second set of elongate protrusions 318, 320 is an end of a double-ended pin 324. That is, first set of elongate protrusions 318 are first ends 326 of double-ended pins 324, and second set of elongate protrusions 320 are second ends 328 of double-ended pins 324. Double-ended pins 324 extend through body 316, and are disposed proximate distal ends 322 of the body. The double-ended pins may be fixed in body 316 by any effective means, such as glue, snap-fit features, or adhesion to a material of body 316. In some examples, additional pins may extend through body 316. Such pins may be double-ended or single ended, blunted or sharp, and may extend partially or fully through the body or be fixed to a surface of the body. Double-ended pins 324 or additional pins may be arranged in any suitable pattern(s) on body 316.

Turning to FIG. 5, length A of the body is approximately 70 millimeters (mm). In other examples, length A may be 60 mm, between 50 and 100 mm, or any appropriate length. Double-ended pins 324 are disposed a distance B from distal ends 322 of body 316. In this example distance B is approximately 12 mm, but distance B may also be between a tenth and a third of length A of body 316, or may be any suitable distance. As shown in FIG. 5, double-ended pins 324 are disposed symmetrically with respect to body 316. In other examples, double-ended pins 324 may be disposed asymmetrically.

FIG. 6 is an end view of pin assembly 312, showing one of the double-ended pins 324. Although FIG. 6 depicts only one of the double-end pins, the other double-ended pin or pins may have the same and/or similar shapes and dimensions as described below and shown in FIG. 6. Length C of the double-ended pin is approximately 18 mm, and diameter F of double-ended pin 324 is approximately 0.71 mm. In some examples, length C may be between 10 and 25 mm, or may be any appropriate length. In some examples, diameter F may be between 0.5 and 1 mm in diameter, or may be any suitable size for use with a garment and/or floral arrangement.

In the pictured embodiment, thickness D of body 316 is approximately 3 mm and width E of body 316 is approximately 4 mm. Body 316 may also have any shape and/or dimensions appropriate to support a floral arrangement. Double-ended pin 324 may be configured to extend approximately 11 mm from second side 352 of the body and approximately 4 mm from first side 350 of the body. That is, first protrusion 318 is approximately 4 mm and second protrusion 320 is approximately 11 mm. Although first protrusion 318 is shorter in length than second protrusion 320, the first and second protrusions may have any suitable size(s) and/or dimension(s). Further, each pin of the first and second protrusions may be longer, shorter, or the same relative to each other. Body 316 may be disposed at any point along length C of double-ended pin 324.

In the present embodiment, double-ended pins 324 is comprised of a metal material while body 316 is comprised of plastic. The double-ended pins may be stainless steel, nickel-plated steel, or any rigid material. Body 316 may be any lightweight and durable material, including plastic, resin, or aluminum. The body may be colored to match standard floral tape colors, garment colors, or may be a neutral color.

Figure 7:
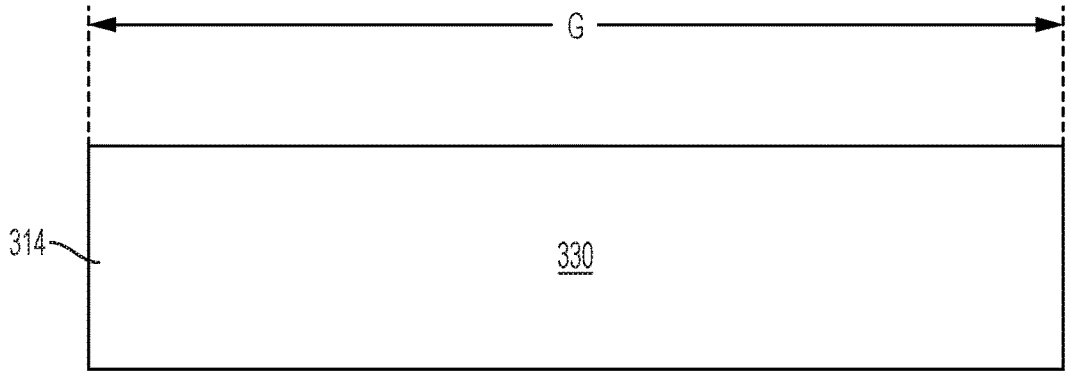
FIG. 7 is a side view of another example of a base.
Figure 8:
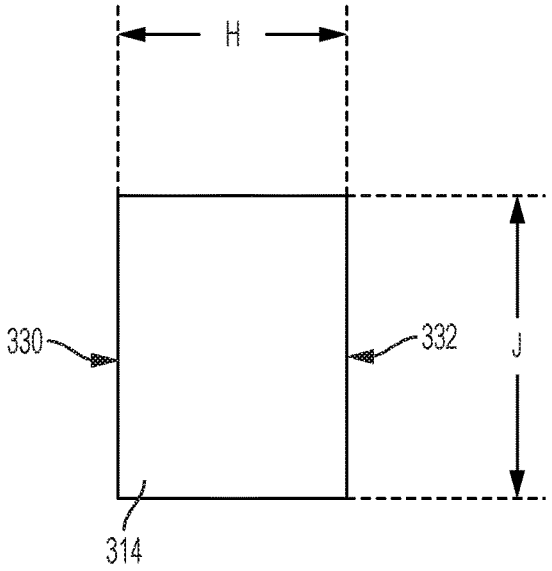
FIG. 8 is an end view of the base of FIG. 7.

FIGS. 7-8 show an example of a base 314 configured to receive second set of elongate protrusions 320 and/or second ends 328 of the double-ended pins of pin assembly 312 shown in FIGS. 5-6. Base 314 is generally rectangular, and made of foam. The foam may be of a density and material such that it receives and retains the pin when the pin is applied with a minimal force, then releases the pin when a similar force is applied in an opposite direction.

A sharp distal end of the pin may pierce the foam of base 314, displacing the foam material to allow at least a portion of the pin to be received in the base. Base 314 may be a solid piece of foam, without apertures and the pin may be able to pierce base 314 at any point. Once received in the base, the foam may resist any movement of the pin not along an axis defined by the longitudinal extent of the pin. The pin assembly may thereby substantially maintain position relative to the base against gravitation forces exerted by an attached floral arrangement, while allowing the pin assembly to be mated with or removed from base 314 with minimal force.

FIG. 7 is a side view of base 314, showing a first surface 330. A user may insert the second set of elongate protrusions of the double-end pins through first surface 330 into an interior of base 314. Length G of base 314 is approximately 70 mm, and substantially matches the length of the body of pin assembly 312 (e.g. length A). In other embodiments, length G may be 60 mm, may be between 50 and 100 mm, or may be any length that matches or does not substantially match the length of the body of the pin assembly.

FIG. 8 is an end view of base 314. Thickness H of the base is approximately 12 mm, and width J of the base is approximately 16 mm. Thickness H of base 314 is greater than the length of the second elongate protrusion of pin assembly 312. That is, when the pin assembly is mated with the base, the second elongate protrusion may not extend through a second surface 332 of base 314.

Width J is also wider than the width of the body of pin assembly 312 (e.g. width E). In some examples, base 314 may closely correspond to the size and/or shape of the body. It may be desirable for base 314 to be larger or wider than the body, to allow a margin of error for a user mating the pin assembly with the base.

In some embodiments, base 314 may include a layer of material on second surface 332. The material may be resistant to piercing or penetration by pins or other elements of a pin assembly. Such a layer may protect a wearer from accidental injury from a floral attachment assembly by preventing sharp ends of pins from protruding through second surface 332 of base 314.

In some embodiments, base 314 may include a solid material with apertures configured to mate with pins of a pin assembly. For example, base 314 may include jewelry pin style backings. Any fastener features or mechanisms may be used that allow base 314 to retain the pins during use and release the pins when desired by a wearer.

Example 4

Figure 9:
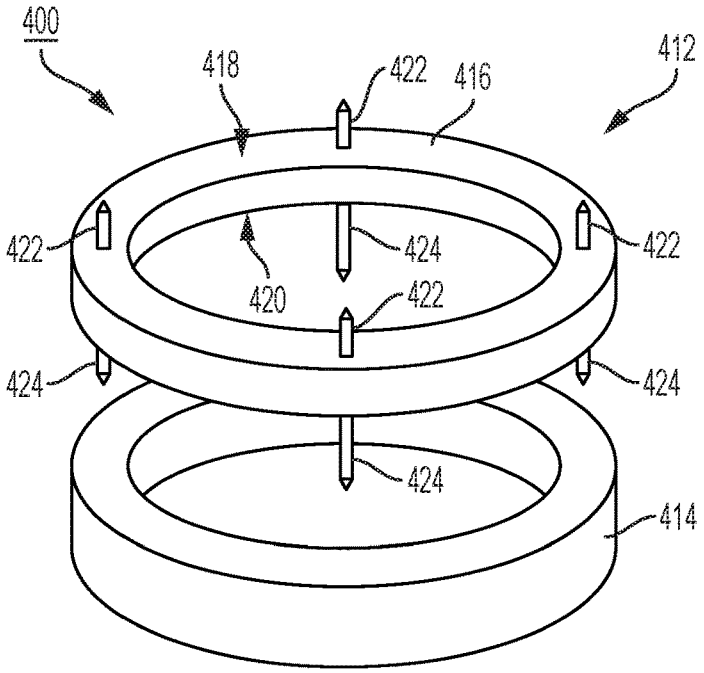
FIG. 9 is an isometric view of another example of a floral attachment assembly.

Another example of a floral attachment assembly is shown in FIG. 9, and generally designated at 400. Unless explicitly excluded, floral attachment assembly 400 may include one or more components and/or one or more functions of other floral attachment assemblies described in the present disclosure.

Floral attachment assembly 400 includes a pin assembly 412 and a base 414. The pin assembly includes an annular body 416, with a first side 418 and a second side 420. A first set of pins 422 are equally spaced around body 416, and extend from first side 418. A second set of pins 424 extend from second side 420, generally opposite first set of pins 422. That is, first set of pins 422 and second set of pins 424 are disposed such that each pin of first set of pins 422 is disposed opposite a respective pin of second set of pins 424, and each of the two respective pins extend along a common axis. Each pin of first set of pins 422 forms an angle of approximately 180 degrees with each respective pin of second set of pins 424.

Body 416 may be configured to support a floral arrangement. In some examples, body 416 may have a shape conforming to the floral arrangement. The substantially circular shape of body 416, as shown in FIG. 9, may be advantageous for supporting generally round floral arrangements such as wreaths or knots.

First set of pins 422 may be configured to engage the floral arrangement. For example, one or more pins of the first set of pins may pierce and/or embed in one or more stems of the flower arrangement, and/or may slide between stems. First set of pins 422 may also pierce a stabilizing material of the floral arrangement, such as foam or tissue paper, and/or pierce one or more stems. Flowers and/or stems of the floral arrangement may rest against body 416 when engaged by pin assembly 412, and first set of pins 422 may be sized to be short enough such that the first set of pins do not protrude through and/or extend beyond the floral arrangement. When worn, the floral arrangement may be supported by first set of pins 422 and/or body 416.

By engaging two or more pins of first set of pins 422 with separate portions of the floral arrangement, the floral arrangement may be prevented from twisting relative to pin assembly 412. The floral arrangement may also be further secured to body 416. Wire, ribbon, floral tape, and/or other material, or some combination of these, may be wrapped around body 416 and a portion of the floral arrangement. Support for a round floral arrangement may be better achieved by three or more pins. In other examples, the first set of pins of pin assembly 412 may include one, two, or three pins, or more than four pins.

Second set of pins 424 may be configured to pierce a garment and engage base 414. The second pins may include a sharp distal end to pierce tightly woven fabrics, or may include a rounded distal end to extend through loosely woven fabric. In some examples, second set of pins 424 may have a small diameter, to limit damage to garment or fabric, and/or have a smooth outer surface to avoid snagging or catching the garment or fabric. Although second set of pins 424 of pin assembly 412 is shown to include four pins, the second set of pins may include one, two, or three pins, or more than four pins.

Base 414 may conform to the floral arrangement, may conform to the shape of body 416, and/or may be shaped to facilitate a desired arrangement of second set of pins 424. In use, when second set of pins 424 pierce a garment to engage with the base, the garment may be sandwiched between body 416 and the base. Body 416 may also be prevented from rotating relative to the base. For example, the body may be comprised of one or more plastics.

Example 5

This example describes a method for attaching and/or securing a floral arrangement to a garment. Aspects of a floral attachment assembly such as those shown in FIGS. 1-9 and described above may be utilized in the method steps described below. Where appropriate, reference may be made to these previously disclosed components and systems that may be used in carrying out each step. These references are provided as an example, and are not intended to limit the possible ways of carrying out any particular step of the method. The method described below may not recite the complete process or all steps of the operation. Additionally, the steps need not necessarily all be performed, and in some cases may be performed in a different order than the order shown.

A method for attaching and/or securing a floral arrangement to a garment may be performed in conjunction with a floral attachment assembly according to aspects of the present disclosure. The floral attachment assembly may have some or all of the characteristics described above and shown in FIGS. 1-9, such as a pin assembly and a base. In some examples, the floral attachment assembly may further include a floral arrangement. The pin assembly may include a first set of pins and a second set of pins disposed on a body of the pin assembly.

The pin assembly is placed and/or embedded within a floral arrangement.

The pin assembly is secured and/or attached to the floral arrangement. For example, the pin assembly may be secured to the floral arrangement with floral tape, wire, ribbon, and/or other suitable structures. In some examples, one or more pins on the pin assembly may be pierced in one or more stems of the floral arrangement.

A user selects a desired portion of a garment to position and/or attach the floral arrangement.

The base is positioned at or adjacent to the desired portion of the garment on an inner surface of the garment.

The pin assembly is positioned at or adjacent to the desired portion of the garment on an outer surface of the garment. In some examples, a user may push one or more pins of the pin assembly through the garment.

The user applies force to the pin assembly generally towards the base and/or to the base generally towards the pin assembly. In some examples, a user may apply force until the garment is cohesive with and/or compressed between the base and the pin assembly.

The user may remove the pin assembly from the base as desired.

The floral arrangement may be re-attached and/or re-secured, for example as described above.

Example 6

Figure 10:
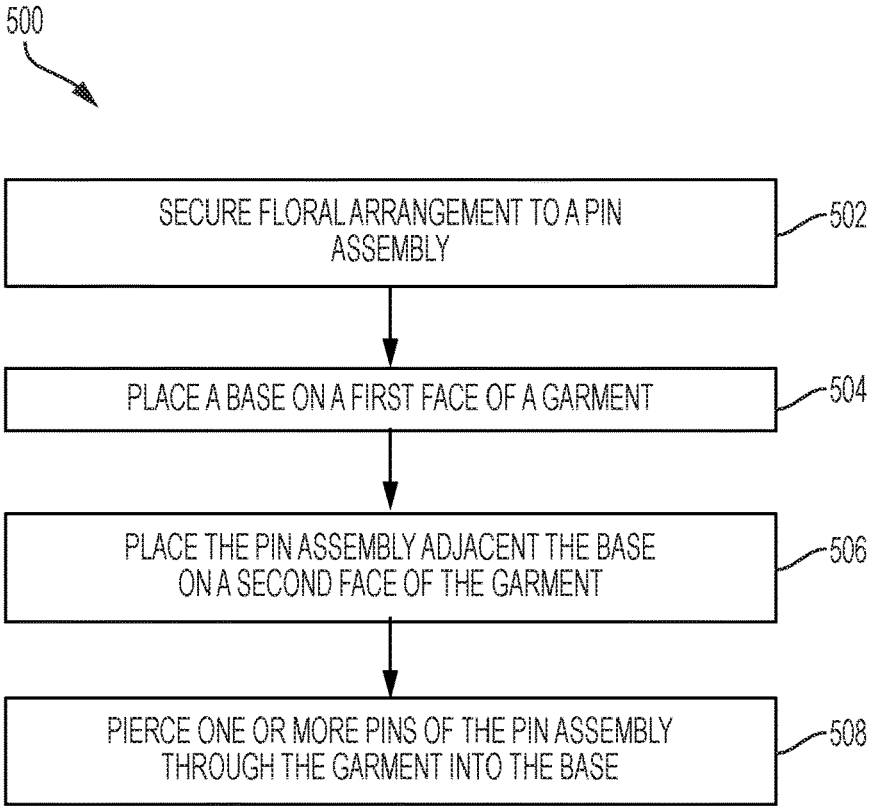
FIG. 10 is a flow chart illustrating a method of attaching a floral arrangement to a garment.

FIG. 10 is a flowchart illustrating an exemplary method 500, for attaching a floral arrangement to garment. The method described below may not recite the complete process or all steps of the operation. Additionally, the steps need not necessarily all be performed, and in some cases may be performed in a different order than the order shown.

Step 502 of method 500 includes securing a floral arrangement to a pin assembly. The pin assembly may include a body configured to support the floral arrangement, and at least one pin may be coupled to the body. Securing the floral arrangement may include embedding a pin of the pin assembly in the floral arrangement. The pin may pierce one or more stems, may extend between stems, and/or may pierce other material(s) of the floral arrangement. Securing the floral arrangement may further include taping and/or wrapping a material around the floral arrangement to the body. Floral tape, ribbon, or even wire may be wrapped around a portion of the body and/or a portion of the floral arrangement.

Step 504 of method 500 includes placing a base on a first face of a garment. This may be an inner side of the garment. The base may be comprised of a foam material, and/or other material(s) appropriate to be worn against the user's skin. The base may be placed inside all layers of the garment, or may be placed on an inner side of a layer or material of the garment.

Step 506 of method 500 includes placing the pin assembly adjacent the base on a second face of the garment. This may be an outer side of the garment. The base may be larger than the pin assembly, to allow approximate placement and a margin of error. The user may adjust placement of the base and/or the pin assembly and attached floral arrangement before proceeding to the next step, to find a preferred placement and/or orientation of the floral arrangement relative to the garment.

Step 508 of method 500 includes piercing one or more pins of the pin assembly through the garment into the base. The one or more pins may be coupled to the body of the pin assembly, and may be generally opposite a pin engaging the floral arrangement. The user may pierce the one or more pins through all layers of the garment, or through one layer or material of the garment depending on the location of the base relative to the pin assembly. The one or more pins may be received by the base, and retained to secure the pin assembly and therefore the floral arrangement to the garment as desired.

Claim Concepts and Selected Embodiments

This section describes additional aspects and features of embodiments, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A floral attachment assembly comprising any feature described herein, either individually or in combination with any other such feature, in any configuration.

B0. A process for attaching and/or securing a floral arrangement, the process comprising any process step described herein, in any order, using any modality.

C0. A floral attachment assembly comprising:

A pin assembly including a plurality of pins and a body;

A base;

Wherein the pin assembly is secured to a garment by piercing one or more pins through the garment and mating with the base.

C1. The floral attachment assembly of C0, wherein the pins of the pin assembly are attached perpendicular to the body.

C2. The floral attachment assembly of C0, wherein the pins of the pin assembly include a first set of pins configured to engage with a floral arrangement.

C3. The floral attachment assembly of C2, wherein the pin assembly includes a second set of pins configured to engage with the base.

C4. The floral attachment assembly of C2, wherein the first set of pins is oriented 180 degrees relative to the second set of pins.

C5. The floral attachment assembly of C0, wherein the base is made of a material suitable for securing the pins of the pin assembly.

C6. The floral attachment assembly of C0, further including a floral arrangement.

C7. The floral attachment assembly of C2, wherein the first set of pins are embedded within the floral arrangement.

C8. The floral attachment assembly of C0, wherein the mating with the base includes piercing one or more pins into the base.

D0. A floral attachment assembly comprising:

a pin assembly including:

a body portion configured to support a floral arrangement, a first plurality of pins protruding from the body in a first direction, and a second plurality of pins protruding from the body in a second direction generally opposite the first direction; and a base configured to receive the second plurality of pins, such that the base is removably attachable to the pin assembly;

wherein the first plurality of pins is configured to secure the floral arrangement to the body portion, and the second plurality of pins is configured to pierce a garment and secure the pin assembly to the garment when mated with the base.

D1. The floral attachment assembly of D0, wherein the first plurality of pins and the second plurality of pins extend perpendicular to a longitudinal axis of the body.

D2. The floral attachment assembly of D0, wherein each of the first plurality of pins has a first length and each of the second plurality of pins has a second length greater than the first length.

D3. The floral attachment assembly of D2, wherein the first length is approximately 4 millimeters.

D4. The floral attachment assembly of D3, wherein the second length is approximately 11 millimeters.

D5. The floral attachment assembly of D0, wherein the first direction is approximately 180 degrees from the second direction, and each pin of the second plurality of pins is disposed opposite a respective pin of the first plurality of pins.

D6. The floral attachment assembly of D0, wherein each pin of the first plurality of pins has a sharp end.

D7. The floral attachment assembly of D0, wherein the body has a shape conforming to the floral arrangement.

D8. The floral attachment assembly of D7, wherein the base conforms to the shape of the body.

D9. The floral attachment assembly of D0, wherein the body has an elongate shape including a first end and a second end, the second plurality of pins including a first pin coupled proximate the first end of the body and a second pin coupled proximate the second end of the body.

D10. The floral attachment assembly of D0, further including a floral arrangement.

E0. A floral attachment assembly comprising:

a body with a first side and an opposing second side;

a first elongate protrusion extending out from the first side;

a second elongate protrusion extending out from the second side; and a base configured to receive the second elongate protrusion;

wherein the first elongate protrusion is configured to engage a floral arrangement, and the second elongate protrusion is configured to secure the body to a garment when received by the base.

E1. The floral attachment assembly of E0, wherein the base comprises a foam.

E2. The floral attachment assembly of E0, wherein the first elongate protrusion and the second elongate protrusion extend along a common axis.

E3. The floral attachment assembly of E0, wherein the first elongate protrusion is a first end of a double-ended pin and the second elongate protrusion is a second end of the double-ended pin, the double-ended pin extending through the body.

E4. The floral attachment assembly of E3, wherein the double-ended pin has a length of approximately 18 millimeters.

E5. The floral attachment assembly of E0, wherein the first elongate protrusion is approximately 4 millimeters in length, and the second elongate protrusion is approximately 11 millimeters in length.

E6. The floral attachment assembly of E0, wherein the base has a thickness greater than a length of the second elongate protrusion.

F0. A method of attaching a floral arrangement to a garment, comprising:

securing a floral arrangement to a body of a pin assembly;

disposing a base portion on a first face of a garment;

disposing the pin assembly on a second face of the garment;

piercing a pin of the pin assembly through the garment into the base.

F1. The method of F0, wherein securing the floral arrangement includes embedding a second pin of the pin assembly in the floral arrangement.

F2. The method of F1, wherein securing the floral arrangement further includes taping the floral arrangement to the body of the pin assembly.

Advantages, Features, Benefits

The different embodiments and examples of the floral attachment assembly described herein provide several advantages over known solutions for attaching floral arrangement to garments. For example, illustrative embodiments and examples described herein may provide the following advantages, features, and/or benefits:

Facilitates a more secure attachment of a floral arrangement to a garment.

Allows a single user to attach a floral arrangement to his/her own garment.

The thickness of the flower stems and/or wires added by a florist is less important and/or challenging when attaching a floral arrangement.

Allows a florist the option to add a floral attachment assembly ahead of providing it to a user.

Distributes the weight of a floral arrangement across a garment and/or a floral attachment assembly for greater stability and/or securing of the floral arrangement.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A floral attachment assembly comprising:

a body with a first side and an opposing second side;

a first elongate protrusion extending out from the first side;

a second elongate protrusion extending out from the second side; and a base configured to receive the second elongate protrusion;

wherein the first elongate protrusion is configured to engage a floral arrangement, and the second elongate protrusion is configured to secure the body to a garment when received by the base;

wherein the first elongate protrusion is a first end of a double-ended pin and the second elongate protrusion is a second end of the double-ended pin, the double-ended pin extending through the body.

2. The floral attachment assembly of claim 1, wherein the base comprises a foam.

3. The floral attachment assembly of claim 1, wherein the first elongate protrusion and the second elongate protrusion extend along a common axis.

4. The floral attachment assembly of claim 1, wherein the double-ended pin has a length of approximately 18 millimeters.

5. The floral attachment assembly of claim 1, wherein the first elongate protrusion extends approximately 4 millimeters in length from the first side of the body, and the second elongate protrusion extends approximately 11 millimeters in length from the second side of the body.

6. The floral attachment assembly of claim 1, wherein the base has a thickness greater than a length of the second elongate protrusion.

7. The floral attachment assembly of claim 1, further including a second double-ended pin extending through the body, wherein a first end of the second double-ended pin is a third elongate protrusion extending from the first side of the body and a second end of the second double-ended pin is a fourth elongate protrusion extending from the second side of the body.

8. The floral attachment assembly of claim 7, further including a third double-ended pin extending through the body, wherein a first end of the third double-ended pin is a fifth elongate protrusion extending from the first side of the body and a second end of the third double-ended pin is a sixth elongate protrusion extending from the second side of the body.

9. The floral attachment assembly of claim 1, wherein the first elongate protrusion and the second elongate protrusion extend perpendicular to a longitudinal axis of the body.

10. The floral attachment assembly of claim 1, wherein the body has a shape conforming to the floral arrangement.

11. The floral attachment assembly of claim 1, wherein the base conforms to the shape of the body.

12. A method of attaching a floral arrangement to a garment, comprising:

securing a floral arrangement to a body of a pin assembly;

disposing a base portion on a first face of a garment;

disposing the pin assembly on a second face of the garment;

piercing a first pin of the pin assembly through the garment into the base;

wherein securing the floral arrangement includes embedding a second pin of the pin assembly in the floral arrangement.

13. The method of claim 12, wherein securing the floral arrangement further includes taping the floral arrangement to the body of the pin assembly.

14. The method of claim 12, wherein securing the floral arrangement further includes embedding a third pin of the pin assembly in the floral arrangement.

* * * * *